US007592301B2

(12) United States Patent
Smith et al.

(10) Patent No.: US 7,592,301 B2
(45) **Date of Patent: *Sep. 22, 2009**

(54) CLEANING COMPOSITION FOR HANDLING WATER HARDNESS AND METHODS FOR MANUFACTURING AND USING

(75) Inventors: Kim R. Smith, Woodbury, MN (US); Mark D. Levitt, St. Paul, MN (US); Stephen Engel, Mounds View, MN (US); David J. Falbaum, Minneapolis, MN (US); Jerry D. Hoyt, Hastings, MN (US)

(73) Assignee: Ecolab Inc., Eagan, MN (US)

( * ) Notice: Subject to any disclaimer, the term of this patent is extended or adjusted under 35 U.S.C. 154(b) by 491 days.

This patent is subject to a terminal disclaimer.

(21) Appl. No.: 10/723,455

(22) Filed: Nov. 25, 2003

(65) Prior Publication Data

US 2004/0154640 A1 Aug. 12, 2004

Related U.S. Application Data

(60) Provisional application No. 60/458,196, filed on Nov. 27, 2002.

(51) Int. Cl.
*C11D 17/00* (2006.01)

(52) U.S. Cl. ..... 510/180; 510/181; 510/182; 510/476; 510/479; 510/499

(58) Field of Classification Search ..... None
See application file for complete search history.

(56) References Cited

U.S. PATENT DOCUMENTS

| | | | |
|---|---|---|---|
| 4,260,528 | A | 4/1981 | Fox et al. |
| 5,273,677 | A | 12/1993 | Arif |
| 5,352,376 | A | 10/1994 | Gutzman |
| 5,447,648 | A | 9/1995 | Steindorf |
| 5,486,307 | A | 1/1996 | Misselyn et al. |
| 5,501,815 | A | 3/1996 | Man |
| 5,516,452 | A | 5/1996 | Welch et al. |
| 5,534,198 | A | 7/1996 | Masters et al. |
| 5,534,199 | A | 7/1996 | Winkler, III |
| 5,545,352 | A | 8/1996 | Pike |
| 5,552,079 | A | 9/1996 | Roach et al. |
| 5,589,099 | A | 12/1996 | Baum |
| 5,602,093 | A | 2/1997 | Haerer et al. |
| 5,712,244 | A | 1/1998 | Addison et al. |
| 5,739,099 | A | 4/1998 | Welch et al. |
| 5,750,482 | A | 5/1998 | Cummings |
| 5,798,324 | A | 8/1998 | Svoboda |
| 5,849,681 | A | 12/1998 | Neumiller et al. |
| 5,880,088 | A | 3/1999 | Lentsch et al. |
| 6,420,326 | B1 | 7/2002 | Maile et al. |
| 6,673,760 | B1 | 1/2004 | Lentsch et al. |

FOREIGN PATENT DOCUMENTS

| | | | |
|---|---|---|---|
| CA | 2292966 | * | 12/1999 |
| EP | 0 595 590 | A | 5/1994 |
| EP | 0630965 | * | 6/1994 |
| EP | 0 630 965 | A | 12/1994 |
| GB | 2311537 | A | 10/1997 |
| JP | 1001790 | | 1/1998 |
| WO | WO 94/14942 | A | 7/1994 |
| WO | WO 96/08553 | | 3/1996 |
| WO | WO 96/10068 | | 4/1996 |
| WO | WO 00/39268 | A | 7/2000 |
| WO | WO 02/12422 | A | 2/2002 |

OTHER PUBLICATIONS

Rosen, M., Characteristic Features of Surfactants, *Surfactants and Interfacial Phenomena*, Second Edition, John Wiley & Sons, 1989, pp. 7-17.

Acusol Detergent Polymers, "Physical Properties and General Applications," Rohm & Haas, Jun. 1998.

* cited by examiner

*Primary Examiner*—Necholus Ogden, Jr.
(74) *Attorney, Agent, or Firm*—Faegre & Benson LLP

(57) ABSTRACT

A cleaning composition is provided. The cleaning composition includes an anionic surfactant and a water hardness anti-precipitant mixture. The water hardness anti-precipitant mixture includes a dispersant and at least one of a sheeting agent and a humectant. The weight ratio of the dispersant to the total amount of the sheeting agent and the humectant can be at least about 1:75 and less than about 75:1. Methods for providing and using a ready to use cleaning composition are provided.

12 Claims, No Drawings

CLEANING COMPOSITION FOR HANDLING WATER HARDNESS AND METHODS FOR MANUFACTURING AND USING

CROSS REFERENCE TO RELATED APPLICATION

This application claims priority to U.S. Provisional Patent Application Ser. No. 60/458,196 that was filed with the United States Patent and Trademark Office on Nov. 27, 2002. The entire disclosure of U.S. Provisional Patent Application Ser. No. 60/458,196 is incorporated herein by reference.

FIELD OF THE INVENTION

The invention relates to a cleaning composition and to methods for manufacturing and using a cleaning composition. In particular, the cleaning composition resists precipitation of anionic surfactant as a result of dilution with hard water. The cleaning composition can be provided as a concentrate and diluted with dilution water to provide a detergent use solution.

BACKGROUND OF THE INVENTION

Glass cleaners are often available in a form that is ready to use. A consumer will purchase a glass cleaner, such as, a window cleaner, and use the glass cleaner directly on a glass surface. It is believed that one reason that glass cleaners are provided in a form that is ready to use is to control the presence of "hardness" in the water used to prepare the ready to use glass cleaner. Water hardness has a tendency to cause precipitation of anionic surfactant. Because glass cleaners contain a large percentage of water, deionized water is often used to formulate the glass cleaners in order to avoid precipitation of anionic surfactants present in the glass cleaners.

Exemplary disclosures of glass cleaner compositions include U.S. Pat. No. 6,420,326 to Maile et al., U.S. Pat. No. 5,534,198 to Masters et al., U.S. Pat. No. 5,750,482 to Cummings, U.S. Pat. No. 5,798,324 to Svoboda, and U.S. Pat. No. 5,849,681 to Newmiller.

SUMMARY OF THE INVENTION

A cleaning composition is provided according to the invention. The cleaning composition includes an anionic surfactant component and a water hardness anti-precipitant mixture. The water hardness anti-precipitant mixture includes a dispersant and at least one of a sheeting agent and a humectant. The water hardness anti-precipitant mixture can include a mixture of the sheeting agent and the humectant.

The ratio of the dispersant to the total amount of the sheeting agent and the humectant should be sufficient to prevent visible precipitation of the anionic surfactant on a surface that is cleaned using the cleaning composition according to the invention. In addition, it should be understood that the total amount of the sheeting agent and the humectant refers to the total amount of the sheeting agent, if present at all, and the total amount of the humectant, if present at all. The weight ratio of the dispersant to the total amount of the sheeting agent and the humectant can be at least about 1:75 and can be less than about 75:1.

The cleaning composition can be provided in the form of a concentrate or in the form of a ready to use composition or in the form of a use solution. In general, it is expected that the concentrate will be diluted to the ready to use composition. Depending upon how the cleaning composition is intended to be used, the ready to use composition can be used as the use solution or it can be diluted to form the use solution. In the case of a glass cleaner, it is expected that the ready to use composition and the use solution will be the same because the ready to use composition is typically applied directly to a surface.

A method for providing a ready-to-use cleaning composition is provided according to the invention. The method includes a step of diluting a cleaning composition concentrate with water of dilution to provide a ready-to-use composition. The water of dilution can include water hardness at a level of at least about 1 grain.

A method for using a cleaning composition is provided according to the invention. The method includes a step of diluting a concentrate with water of dilution to provide a ready to use composition, and applying the ready to use composition to a surface. The method can include a step of foaming the ready to use cleaning composition so that a foam of the ready to use composition is applied to the surface for cleaning. The step of foaming can be provided by mechanical foaming without a propellant. It is expected that foaming a ready to use cleaning composition will be useful when cleaning glass.

DETAILED DESCRIPTION OF THE INVENTION

The cleaning composition can be referred to as a detergent composition and can be provided in the form of a concentrated detergent composition, a ready to use detergent composition, and/or a detergent use solution. The concentrated detergent composition can be referred to as the concentrate, and can be diluted to provide the ready to use detergent composition. The concentrate can be diluted in stages to eventually provide a ready to use detergent composition. The ready to use detergent composition can be referred to as the use solution when it is the solution that is intended to be used to provide cleaning of a surface. In addition, the ready to use detergent composition can be further diluted to provide the use solution that is intended to be used to clean a surface. In the case of a glass cleaner, it is expected that the ready to use solution will be the use solution and applied directly to a surface without further diluting. It is expected that when cleaning certain hard surfaces, that can include glass, it may be desirable to dilute the ready to use solution and clean the hardsurface with the resulting use solution.

The cleaning composition can be provided as a concentrate for shipment to retail distributors or commercial end users. It is expected that the retail distributors or the commercial end users will dilute the concentrate to provide a less concentrated detergent composition and/or a ready to use detergent composition. It is expected that the retail distributors will package and sell the less concentrated detergent composition or the ready to use detergent composition to consumers. In the case of a glass cleaner, it is expected that the retail distributor will dilute the concentrate to provide a glass cleaner in a ready to use form, and then package the glass cleaner for sale to consumers. It is expected that commercial end users, such as, car washing facilities and janitorial services, will dilute the concentrate to achieve a ready to use composition and then use the ready to use composition as part of their cleaning service.

By providing the cleaning composition as a concentrate, it is expected that the concentrate will be diluted with the water available at the locale or site of dilution. It is recognized that the level of water hardness changes from one locale to another. Accordingly, it is expected that that concentrate will be diluted with water having varying amounts of hardness depending upon the locale or site of dilution. In general, water hardness refers to the presence of calcium, magnesium, iron, manganese, and other polyvalent metal cations that may be present in the water, and it is understood that the level of water hardness varies from municipality to municipality. The concentrated detergent composition is formulated to handle differing water hardness levels found in varying locations without having to soften the water or remove the hardness from the water. High solids containing water is considered to be water having a total dissolved solids (TDS) content in excess of 200 ppm. In certain localities, the service water contains a total dissolved solids content in excess of 400 ppm, and even in excess of 800 ppm. Water hardness can be characterized by the unit "grain" where one grain water hardness is equivalent to 17.1 ppm hardness expressed as $CaCO_3$. Hard water is characterized as having at least 1 grain hardness. Water is commonly available having at least 5 grains hardness, at least 10 grains hardness, and at least 20 grains hardness.

The hardness in water can cause anionic surfactants to precipitate. Visual precipitation refers to precipitate formation that can be observed by the naked eye without visual magnification or enhancement. In order to protect the anionic surfactant component in the cleaning composition of the invention, a water hardness anti-precipitant mixture is provided that includes a dispersant and at least one of a sheeting agent and a humectant. The cleaning composition can include additional surfactants and other components commonly found in cleaning compositions.

Anionic Surfactant Component

The anionic surfactant component includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Exemplary groups of anionic surfactants include sulfonates and sulfates. Exemplary surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Exemplary alkyl aryl sulfonates that can be used in the cleaning composition can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate.

Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant.

Exemplary alkyl methyl ester sulfonates that can be used in the cleaning composition include those having an alkyl group containing 6 to 24 carbon atoms.

Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauric ether ethoxylate sulfate and is available under the name Steol CS-460.

Exemplary alkyl sulfates that can be used in the cleaning composition include those having an alkyl group containing 6 to 24 carbon atoms. Exemplary alkyl sulfates include sodium laurel sulfate and sodium laurel/myristyl sulfate.

Exemplary alcohol sulfates that can be used in the cleaning composition include those having an alcohol group containing about 6 to about 24 carbon atoms.

The anionic surfactant can be neutralized with an alkaline metal salt, an amine, or a mixture thereof. Exemplary alkaline metal salts include sodium, potassium, and magnesium. Exemplary amines include monoethanolamine, triethanolamine, and monoisopropanolamine. If a mixture of salts is used, an exemplary mixture of alkaline metal salt can be sodium and magnesium, and the molar ratio of sodium to magnesium can be between about 3:1 and about 1:1.

The cleaning composition, when provided as a concentrate, can include the anionic surfactant component in an amount sufficient to provide a use solution having desired wetting and detersive properties after dilution with water. In general, the concentrate can be provided as a solid or as a liquid. When the concentrate is provided as a liquid, it can be provided in a form that is readily flowable so that it can be pumped or aspirated. It is additionally desirable to minimize the amount of water while preserving the flowable properties of the concentrate when it is provided as a fluid. The concentrate can contain between about 0.1 wt. % and about 10 wt. % of the anionic surfactant component, between about 0.2 wt. % and about 5 wt. % of the anionic surfactant component, and between about 0.5 wt. % and about 1.5 wt. % of the anionic surfactant component.

Water Hardness Anti-Precipitant Mixture

The water hardness anti-precipitant includes a mixture of a dispersant and at least one of a sheeting agent and a humectant. The combination of the dispersant and the at least one of a sheeting agent and a humectant provides the use solution with resistance to precipitation of the anionic surfactant component caused by hardness in the water. In addition, it is believed that the combination of the dispersant and the sheeting agent and/or the humectant can provide stability from precipitation at temperatures down to about 40° F., and at temperatures down to freezing. The dispersant and the sheeting agent and/or the dispersant are believed to act synergistically to provide protection against precipitation of anionic surfactants in the presence of hard water.

The dispersant is a component that is conventionally added to cleaning compositions to handle the hardness found in water. Dispersants that can be used according to the invention include those that are referred to as "lime soap dispersants." In general, it is understood that dispersants have a tendency to interfere with precipitation of anionic surfactants caused by water hardness.

Dispersants that can be used according to the invention can include a polymer and/or an oligomer containing pendant carboxylic acid groups and/or pendant carboxylic acid salt groups. It should be understood that the term "pendant" refers to the groups being present other than in the polymer backbone and/or oligomer backbone. The dispersants can be available as homopolymers or co-polymers or as homoligomers or co-oligomers. Exemplary dispersants include poly(acrylic acid), poly (acrylic acid/maleic acid) co-polymers, poly(maleic acid/olefin) co-polymers, phosphino carboxylated polymers, and mixtures thereof. The dispersants can be soluble or dispersable in the concentrate and can be a component that does not significantly increase the viscosity of the concentrate or of the use solution relative to its absence. The dispersant can be a homopolymer or co-polymer, and can have a molecular weight range of about 300 to about 5,000,000, and can have a molecular weight range of about 2,000 to about 2,000,000, and can have a molecular weight range of about 3,000, to about 500,000. The dispersant can include repeating units based upon acrylic acid, maleic acid, polyols, olefins, and mixtures thereof. An exemplary dispersant is a maleic anhydride/olefin co-polymer. An exemplary maleic anhydride/olefin co-polymer is available from Rohm & Haas under the name of Acusol 460N. An exemplary polyacrylic acid sodium salt having a molecular weight of about 4,500 is available from Rohm & Haas under the name Acusol 434N. An exemplary acrylic acid/maleic acid co-polymer having a molecular weight of about 3,200 is available from Rohm & Haas under the Acusol 448. An exemplary acrylic acid/maleic acid sodium salt having a molecular weight of about 70,000 is available from Rohm & Haas under the name Acusol 479N. An exemplary acrylic acid/maleic acid sodium salt having a molecular weight of about 40,000 is available from Rohm & Haas under the name Acusol 505N. In general, if the dispersant is provided as an acid, its pH may be adjusted to neutral or alkaline. The pH adjustment may be provided prior to forming the concentrate or during the formation of the concentrate. In addition, the pH adjustment may occur at any time prior to or during dilution with the water of dilution to provide the use solution. The dispersant can be provided in the concentrate in an amount sufficient, when taken in consideration of the amount of sheeting agent and/or humectant, to provide resistance to precipitation of the anionic surfactant component when diluted with hard water. In general, the concentrate can contain between about 0.01 wt. % and about 10 wt. % dispersant, between about 0.2 wt. % and about 5 wt. % dispersant, and between about 0.5 wt. % and about 1.5 wt. % dispersant.

The sheeting agent and/or humectant can be any component that provides a desired level of sheeting action and, when combined with the dispersant, creates a resistance to precipitation of the anionic surfactant component in the presence of hard water.

Exemplary sheeting agents that can be used according to the invention include surfactant including nonionic block copolymers, alcohol alkoxylates, alkyl polyglycosides, zwitterionics, anionics, and mixtures thereof. Additional exemplary sheeting agents include alcohol ethoxylates; alcohol propoxylates; alkylphenol ethoxylate-propoxylates; alkoxylated derivatives of carboxylic acids, amines, amids and esters; and ethylene oxide-propylene oxide copolymers. Exemplary ethylene oxide-propylene oxide polymers include those available under the name Pluronic, Pluronic R, Tetronic, and Tetronic R from BASF.

Exemplary nonionic block copolymer surfactants include polyoxyethylene-polyoxypropylene block copolymers. Exemplary polyoxyethylene-polyoxypropylene block copolymers that can be used have the formulae:

$$(EO)_x(PO)_y(EO)_x$$

$$(PO)_y(EO)_x(PO)_y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. Preferably, x is from about 10 to about 130, y is about 15 to about 70, and x plus y is about 25 to about 200. It should be understood that each x and y in a molecule can be different. The total polyoxyethylene component of the block copolymer is preferably at least about 20 mol-% of the block copolymer and more preferably at least about 30 mol-% of the block copolymer. The material preferably has a molecular weight greater than about 1,500 and more preferably greater than about 2,000. Although the exemplary polyoxyethylene-polyoxypropylene block copolymer structures provided above have 3 blocks and 5 blocks, it should be appreciated that the nonionic block copolymer surfactants according to the invention can include more or less than 3 and 5 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Exemplary sheeting agents that can be used according to the invention are available from BASF under the name Pluronic, and an exemplary EO-PO co-polymer that can be used according to the invention is available under the name Pluronic N3.

A desirable characteristic of the nonionic block copolymers is the cloud point of the material. The cloud point of nonionic surfactant of this class is defined as the temperature at which a 1 wt-% aqueous solution of the surfactant turns cloudy when it is heated. BASF, a major producer of nonionic block copolymers in the United States recommends that rinse agents be formulated from nonionic EO-PO sheeting agents having both a low molecular weight (less than about 5,000) and having a cloud point of a 1 wt-% aqueous solution less than the typical temperature of the aqueous rinse. It is believed that one skilled in the art would understand that a nonionic surfactant with a high cloud point or high molecular weight would either produce unacceptable foaming levels or fail to provide adequate sheeting capacity in a rinse aid composition.

The alcohol alkoxylate surfactants that can be used as sheeting agents according to the invention can have the formula:

$$R(AO)_x—X$$

wherein R is an alkyl group containing 6 to 24 carbon atoms, AO is an alkylene oxide group containing 2 to 12 carbon atoms, x is 1 to 20, and X is hydrogen or an alkyl or aryl group containing 1-12 carbon atoms. The alkylene oxide group is preferably ethylene oxide, propylene oxide, butylene oxide, or mixture thereof. In addition, the alkylene oxide group can include a decylene oxide group as a cap.

The alkyl polyglycoside surfactants that can be used as sheeting agents according to the invention can have the formula:

$$(G)_x—O—R$$

wherein G is a moiety derived from reducing saccharide containing 5 or 6 carbon atoms, e.g., pentose or hexose, R is a fatty aliphatic group containing 6 to 24 carbon atoms, and x is the degree of polymerization (DP) of the polyglycoside representing the number of monosaccharide repeating units in the polyglycoside. The value of x can be between about 0.5 and about 10. R can contain 10-16 carbon atoms and x can be 0.5 to 3.

The zwitterionic surfactants that can be used as sheeting agents according to the invention include β-N-alkylaminopropionates, N-alkyl-β-iminodipropionates, imidazoline carboxylates, N-alkylbetaines, sulfobetaines, sultaines, amine oxides and polybetaine polysiloxanes. Preferred polybetaine polysiloxanes have the formula:

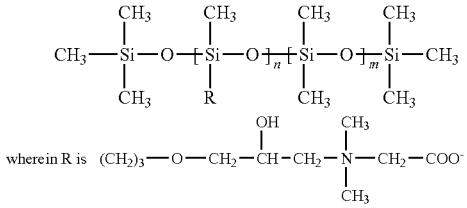

n is 1 to 100 and m is 0 to 100, preferably 1 to 100. Preferred polybetaine polysiloxanes are available under the name ABIL® from Goldschmidt Chemical Corp. Preferred amine oxides that can be used include alkyl dimethyl amine oxides containing alkyl groups containing 6 to 24 carbon atoms. A preferred amine oxide is lauryl dimethylamine oxide.

The anionic surfactants that can be used as sheeting agents according to the invention include carboxylic acid salts, sulfonic acid salts, sulfuric acid ester salts, phosphoric and polyphosphoric acid esters, perfluorinated anionics, and mixtures thereof. Exemplary carboxylic acid salts include sodium and potassium salts of straight chain fatty acids, sodium and potassium salts of coconut oil fatty acids, sodium and potassium salts of tall oil acids, amine salts, sarcosides, and acylated polypeptides. Exemplary sulfonic acid salts include linear alkylbenzenesulfonates, $C_{13}$-$C_{15}$ alkylbenzenesulfonates, benzene cumenesulfonates, toluene cumenesulfonates, xylene cumenesulfonates, ligninsulfonates, petroleum sulfonates, N-acyl-n-alkyltaurates, paraffin sulfonates, secondary n-alkanesulfonates, alpha-olefin sulfonates, sulfosuccinate esters, alkylnaphthalenesulfonates, and isethionates. Exemplary sulphuric acid ester salts include sulfated linear primary alcohols, sulfated polyoxyethylenated straight-chain alcohols, and sulfated triglyceride oils.

Exemplary surfactants which can be used as sheeting agents according to the invention are disclosed in Rosen, Surfactants and Interfacial Phenomena, second edition, John Wiley & sons, 1989, the entire document being incorporated herein by reference. Humectants that can be used according to the invention include those substances that exhibit an affinity for water and help enhance the absorption of water onto a substrate. If the humectant is used in the absence of a sheeting agent, the humectant should be capable of cooperating with the dispersant to resist precipitation of the anionic surfactant in the presence of hard water. Exemplary humectants that can be used according to the invention include glycerine, propylene glycol, sorbitol, alkyl polyglycosides, polybetaine polysiloxanes, and mixtures thereof. The alkyl polyglycosides and polybetaine polysiloxanes that can be used as humectants include those described previously as sheeting agents.

When the humectant is incorporated into the cleaning composition, it can be used in an amount based upon the amount of sheeting agent used. In general, the weight ratio of humectant to sheeting agent can be greater than 1:3, and can be provided at between about 5:1 and about 1:3. It should be appreciated that the characterization of the weight ratio of humectant to sheeting agent indicates that the lowest amount of humectant to sheeting agent is 1:3, and that more humectant relative to the same amount of sheeting agent can be used. The weight ratio of humectant to sheeting agent can be between about 4:1 and about 1:2, and can be between about 3:1 and about 1:1. When using a humectant in the cleaning composition, it is preferable that the sheeting agent and the humectant are not the same chemical molecule. Although alkyl polyglycosides and polybetaine polysiloxanes are identified as both sheeting agents and humectants, it should be understood that the cleaning composition preferably does not have a particular alkyl polyglycoside functioning as both the sheeting agent and the humectant, and preferably does not have a specific polybetaine polysiloxane functioning as the sheeting agent and the humectant. It should be understood, however, that different alkyl polyglycosides and/or different polybetaine polysiloxanes can be used as sheeting agents and humectants in a particular cleaning composition.

It is understood that certain components that are characterized as humectants have been used in prior compositions as, for example, processing aids, hydrotropes, solvents, and auxiliary components. In those circumstances, it is believed that the component has not been used in an amount or an in environment that provides for reducing water solids filming in the presence of high solids containing water. The use of humectants in a rinse agent composition is described in U.S. application Ser. No. 09/606,290 that was filed with the United States Patent and Trademark Office on Jun. 29, 2000, the entire disclosure of which is incorporated herein by reference.

The concentrate can include an amount of sheeting agent and/or humectant that cooperates with the dispersant to resist precipitation of the anionic surfactant by hard water. The concentrate can contain between about 0.001 wt. % and about 10 wt. % of the sheeting agent and/or humectant, between about 0.05 wt. % and about 1 wt. % of the sheeting agent and/or humectant, and between about 0.06 wt. % and about 0.5 wt. % of the sheeting agent and/or humectant.

The amounts of dispersant and at least one of sheeting agent and humectant provided in the cleaning composition can be controlled to handle the water hardness levels expected from various localities as a result of the dilution of the concentrate to a use solution. In general, it is expected that the weight ratio of the dispersant to the total sheeting agent and/or humectant can be between about 1:75 to about 75:1, between about 1:30 to about 30:1, between about 1:25 to about 25:1, between about 1:15 and about 15:1; between about 1:10 and about 10:1, and between about 1:5 and about 5:1.

The Water Component

The concentrate can be provided in the form of a solid, a liquid, or a combination of solid and liquid. The concentrate can be formulated without any water or can be provided with a relatively small amount of water in order to reduce the expense of transporting the concentrate. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. As a result, a concentrate according to the invention, when it includes water, it can include water in an amount of between about 0.1 wt. % and about 99 wt. %, between about 30 wt. % and about 90 wt. %, and between about 60 wt. % and about 89 wt. %.

It should be understood that the water provided as part of the concentrate can be relatively free of hardness. It is expected that the water can be deionized to remove a portion of the dissolved solids. The concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Service water available from various municipalities has varying levels of hardness. It is generally understood that the calcium, magnesium, iron, manganese, or other polyvalent metal cations that may be present can cause precipitation of the anionic surfactant. In general, because of the expected large level of dilution of the concentrate to provide a use solution, it is expected that service water from certain municipalities will have a greater impact on the potential for anionic surfactant precipitation than the water from other municipalities. As a result, it is desirable to provide a concentrate that can handle the hardness levels found in the service water of various municipalities.

When the hardness level is considered to be fairly high, it is difficult to handle the hardness using traditional builders because of the large amount of water of dilution used to dilute the concentrate to form the use solution. Because builders have a tendency to act in a molar relationship with cationic salts, it is expected that the concentrate would require a large amount of a builder component if the builder component was the only component responsible for handling the hardness. Accordingly, even if it is possible to incorporate an amount of builder into the concentrate to prevent precipitation of the anionic surfactant component, it would be desirable to provide a concentrate that did not require so much builder to handle the hardness levels found in the service water of various municipalities.

The water of dilution that can be used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the concentrate contains a large amount of water, it is expected that the concentrate can be diluted with the water of dilution at a weight ratio of at least 1:1 to provide a desired use solution. If the concentrate includes no water or very little water, it is expected that the concentrate can be diluted at a weight ratio of concentrate to water of dilution of up to about 1:1000 in order to provide a desired use solution. It is expected that the weight ratio of concentrate to water of dilution will be between about 1:1 and about 1:100, between about 1:2 and about 1:50, between about 1:10 and about 1:40, and between about 1:15 and about 1:30. In certain preferred applications, the concentrate can be diluted at a weight ratio of concentrate to water of dilution at about 1:16 to provide a consumer glass cleaner, and a weight ratio of about 1:25 to provide a glass cleaning composition for vehicle washing facilities.

Other Components

The detergent composition can include an organic solvent to modify cleaning properties and/or modify the evaporation rate of water from the surface that is cleaned. In general, the properties of modifying cleaning and modifying evaporation can be balanced depending upon the application of the use solution. In addition, the cleaning composition can include a single organic solvent or a mixture of organic solvents.

Exemplary organic solvents that can be used include hydrocarbon or halogenated hydrocarbon moieties of the alkyl or cycloalkyl type, and have a boiling point well above room temperature, i.e., above about 20° C.

Considerations for selecting organic solvents include cleaning properties and aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$-$C_9$ alkyl aromatic solvents, especially the $C_6$-$C_9$ alkyl benzenes, preferably octyl benzene, exhibit excellent grease removal properties and have a low, pleasant odor. Likewise the olefin solvents having a boiling point of at least about 100° C., especially alpha-olefins, preferably 1-decene or 1-dodecene, are excellent grease removal solvents.

Generically, the glycol ethers useful herein have the formula $R^1O—(R^2O—)_m1H$ wherein each $R^1$ is an alkyl group which contains from about 1 to about 8 carbon atoms, each $R^2$ is either ethylene or propylene, and $m^1$ is a number from 1 to about 3. Exemplary glycol ethers include monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy) propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used.

The concentrate can include the organic solvent component in an amount to provide the desired cleaning and evaporative properties. In general, the amount of solvent should be limited so that the use solution is in compliance with volatile organic compound (VOC) regulations for a particular class of cleaner. In addition, it should be understood that the organic solvent is an optional component and need not be incorporated into the concentrate or the use solution according to the invention. When the organic solvent is included in the concentrate, it can be provided in an amount of between about 0.1 wt. % and about 99 wt. %, between about 5 wt. % and about 50 wt. %, and between about 10 wt. % and about 30 wt. %.

It can be desirable to provide the use solution with a relatively neutral or alkaline pH. In many situations, it is believed that the presence of hard water as water of dilution will cause the use solution to exhibit a neutral or alkaline pH. In order to ensure a relatively neutral or alkaline pH, a buffer can be incorporated into the concentrate. In general, the amount of buffer should be sufficient to provide the use solution with a pH in the range of about 6 to 14, and preferably between about 7 and 10.

The buffer can include an alkalinity source. Exemplary alkaline buffering agents include alkanolamines. An exemplary alkanolamine is beta-aminoalkanol and 2-amino-2-methyl-1-propanol(AMP).

Preferred alkanolamines are beta-aminoalkanol compounds. They serve primarily as solvents when the pH is about 8.5, and especially above about 9.0. They also can provide alkaline buffering capacity during use. Exemplary beta-aminoalkanols are 2-amino-1-butanol; 2-amino-2-methyl-1-propanol; and mixtures thereof. The most preferred beta-aminoalkanol is 2-amino-2-methyl-1-propanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Beta-aminoalkanols, and especially monoethanolamine and the preferred 2-amino-2-methyl-1-propanol, are surprisingly volatile from cleaned surfaces considering their relatively high molecular weights. It is found that levels below an equivalent of about 0.010% 2-amino-2-methyl-1-propanol are insufficient to provide the necessary buffering capacity necessary to maintain the pH of the formulations within a narrow range.

Other suitable alkalinity agents that can also be used, but less desirably, include alkali metal hydroxides, i.e., sodium, potassium, etc., and carbonates or sodium bicarbonates. Water-soluble alkali metal carbonate and/or bicarbonate salts, such as sodium bicarbonate, potassium bicarbonate, potassium carbonate, cesium carbonate, sodium carbonate, and mixtures thereof, can be added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof.

Contrary to the teachings of U.S. Pat. No. 6,420,326, the concentrate can include a buffering capacity greater than the equivalent of 0.050 wt. % 2-amino-2-methyl-1-propanol without experiencing deleterious streaking as a glass cleaner composition. In addition, the concentrate can include a buffering capacity greater than the equivalent of 0.070 wt. % of 2-amino-2-methyl-1-propanol, and greater than the equivalent of 0.1 wt. % of 2-amino-2-methyl-1-propanol.

The cleaning composition according to the invention can include complexing or chelating agents that aid in reducing the harmful effects of hardness components in service water. Typically, calcium, magnesium, iron, manganese, or other polyvalent metal cations, present in service water, can interfere with the action of cleaning compositions. A chelating agent can be provided for complexing with the metal cation and preventing the complexed metal cation from interfering with the action of an active component of the rinse agent. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include amino-carboxylates such as salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal ammonium and substituted ammonium salts thereof. Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates amino-carboxylates. These phosphonates commonly contain alkyl or alkylene groups with less than 8 carbon atoms.

It should be understood that the concentrate can be provided without a component conventionally characterized as a builder, a chelating agent, or a sequestrant. Nevertheless, it is believed that these components can advantageously be incorporated into the cleaning composition. It is expected that their presence would not be provided in an amount sufficient to handle the hardness in the water resulting from the water of dilution mixing with the concentrate to form the use solution when the water of dilution is considered to be fairly hard water and the ratio of water of dilution to the concentrate is fairly high.

Optional ingredients which can be included in the cleaning composition of the invention in conventional levels for use include hydrotropes, processing aids, corrosion inhibitors, dyes, fillers, optical brighteners, germicides, pH adjusting agents (monoethanolamine, sodium carbonate, sodium hydroxide, hydrochloric acid, phosphoric acid, et cetera), bleaches, bleach activators, fragrances, viscosity modifiers, and the like.

The ready to use composition and/or the use solution can be foamed during application onto a surface. In the case of a glass cleaner, a foam is generally desirable to provide the composition additional hang time. That is, it is generally desirable to allow the cleaning composition to remain in place on a surface that may be vertical until a user has the opportunity to wipe the cleaner on the surface to provide cleaning. It is believed the cleaning composition can be foamed without the need for certain types of foaming agents such as thickeners. In fact, it is believed that certain thickeners may have an adverse affect on cleaning when used to clean a glass surface if the thickener has a tendency to cause smearing, streaking, or leave a film on the glass surface. Accordingly, thickeners can be excluded from the composition according to the invention. Specific types of thickeners that can be excluded include those thickeners that provide a thickening effect by increasing the viscosity by at least 50 cP. When used as a window cleaner, the cleaning composition can be wiped away, without a water rinse, to provide a streak free glass surface.

An exemplary concentrate according to the invention can be formulated according to Table 1.

TABLE 1

| Component | 1st Range (wt. %) | 2nd Range (wt. %) | 3rd Range (wt. %) |
|---|---|---|---|
| water | 0.1-99 | 30-90 | 60-89 |
| anionic surfactant | 0.1-10 | 0.2-5 | 0.5-1.5 |
| dispersant | 0.01-10 | 0.2-5 | 0.5-1.5 |
| sheeting agent and/or humectant | 0.001-10 | 0.05-1 | 0.06-0.5 |
| organic solvent* | 0.1-99 | 5-50 | 10-30 |

*The organic solvent is optional depending on how the cleaning composition is intended to be used, and can be excluded from the cleaning composition.

An exemplary concentrate composition for use as a glass cleaner is provided in Table 2. The glass cleaner can be diluted with water of dilution at a ratio of concentrate to water of dilution of about 1:15 to provide a consumer glass cleaner product, and can be diluted at a weight ratio of about 1:25 to provide a vehicle care glass cleaner.

TABLE 2

| Components | Concentrate Concentration (wt. %) |
|---|---|
| deionized water | 73.0 |
| dispersant | 1.0 |
| organic solvent | 18.0 |
| buffering agent (99%) | 1.9 |
| sheeting agent | 0.1 |
| anionic surfactant (30%) | 4.9 |
| builder (40%) | 1.0 |
| dye | 0.04 |
| fragrance | 0.10 |

The cleaning composition can be prepared at a first location and shipped or transported to a second location for dilution. The second location can be provided with a water source that includes hardness. An exemplary type of second location is a commercial store where the concentrate is diluted, packaged, and distributed to customers. The second location can be another facility that provides for further dilution and distribution of the product. In addition, the second location can be a job site, such as, a hotel or other building requiring janitorial services. In addition, it should be understood that there can be multiple locations where dilution occurs. For example, an intermediary dilution can occur at the second location, and the final dilution to a use solution can be provided by the consumer at about the time the detergent composition is used for cleaning.

The detergent composition, when provided as a use solution, can be applied to a surface or substrate for cleaning in a variety of forms. Exemplary forms include as a spray and as a foam. In the case of a glass cleaner, it may be desirable to provide the use solution as a foam in order to hinder running of the use solution down a vertical window. It is believed that a pump roamer can be used to create a foam for application to a surface or substrate without the need for propellants or other blowing agents. The foam can be characterized as a mechanically generated foam rather than a chemically generated foam when a hand or finger pump is used to create the foam. An exemplary foaming head that can be used with the detergent composition can be obtained from Zeller in Germany.

It is believed that that cleaning composition can be used as a glass cleaner for cleaning glass surfaces including windows and mirrors. In addition, it is believed that the cleaning composition can be used as a hard surface cleaner, a bathroom cleaner, a dishwash detergent, a floor cleaner, a countertop cleaner, and a metal cleaner. In addition, it is believed that the detergent composition can be used in a car wash facility for cleaning glass, for washing the car, for prewash applications, and for metal brightening. It should be understood that the cleaning composition can be applied directly to a surface such as a glass surface and wiped away to provide a streak free surface. In addition, the detergent composition can be rinsed from a surface with water.

EXAMPLE 1

Precipitation from a Glass Cleaner Diluted with Hard Water

Several cleaner concentrates were prepared and then diluted at a ratio of concentrate to water of 1:16 wherein the dilution water is characterized as 20 grain water to provide use solutions. The use solutions were cooled to 32° F. and the formation of any precipitate noted. The use solutions were also used to clean a dirty window and the appearance of any streaking noted. The results of this example are reported in Table 3.

TABLE 3

| | Composition of Conc. by Wt. % | | | |
|---|---|---|---|---|
| Ingredient | A | B | C | D |
| n-propoxypropanol (100%) | 18 | 18 | 18 | 18 |
| monoethanolamine (100%) | 1.9 | 1.9 | 1.9 | 1.9 |
| sodium lauryl sulfate (30%) | 4.9 | 4.9 | 4.9 | 4.9 |
| tetrasodium EDTA (40% | 1.0 | 1.0 | 1.0 | 1.0 |
| Acusol 460N (25%) | 0 | 1.0 | 0 | 1.0 |
| Pluronic N3 (100%) | 0 | 0 | 0.1 | 0.1 |
| water | quantity sufficient to 100% | | | |
| precipitate formed | room temp. | 62° F. | 32-40° F. | none noted |
| streaking | yes | very slight | very slight. | no |

EXAMPLE 2

Glass Cleaner Panel Test

A glass cleaner ready to use composition was prepared by diluting the glass cleaner concentrate D of Example 1 with dilution water having a water hardness of 20 grain at a ratio of concentrate to water of dilution of 1:16. Ready to use glass cleaner D was compared to the Windex® glass cleaner from S.C. Johnson. Then panelists were asked to take both glass cleaners home for use, and all ten panelists selected glass cleaner D as the best.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A cleaning composition comprising:

(a) an anionic surfactant and an alkanolamine; and (b) a water hardness anti-precipitant mixture comprising 0.5-1.5 wt % of maleic anhydride/olefin co-polymer and 0.001-10 wt % of EO-PO co-polymer at a weight ratio of the maleic anhydride/olefin co-polymer to the EO-PO co-polymer of between about 1:75 and about 75:1, wherein the amount of the water hardness anti-precipitant mixture to the anionic surfactant and amine is sufficient to prevent visible precipitation when the cleaning composition is diluted with dilution water having one grain hardness at a weight ratio of 1:1;

(c) the EO-PO co-polymer having the formula:

$$(EO)_x(PO)_y(EO)_x$$

$$(PO)_y(EO)_x(PO)_y$$

$$(PO)_y(EO)_x(PO)_y(EO)_x(PO)_y$$

wherein EO is an ethylene oxide group, PO is a propylene oxide group, x is between about 10 to about 130 and y is between about 15 to about 70.

2. A cleaning composition according to claim 1, wherein the amount of the water hardness anti-precipitant mixture to the anionic surfactant and amine is sufficient to prevent visible precipitation when the cleaning composition is diluted with dilution water having 20 grain hardness at a weight ratio of 1:16.

3. A cleaning composition according to claim 1, wherein the cleaning composition contains between about 0.1 wt. % and about 10 wt. % of the anionic surfactant and the alkanolamine.

4. A cleaning composition according to claim 1, further comprising an organic solvent.

5. A cleaning composition according to claim 4, wherein the organic solvent comprises at least one of glycol ether and derivatives of glycol ether.

6. A cleaning composition according to claim 4, wherein the cleaning composition comprises between about 0.1 wt. % and about 99 wt. % of the organic solvent.

7. A cleaning composition according to claim 1, further comprising between about 0.1 wt. % and about 99 wt. % deionized water.

8. A cleaning composition according to claim 7, wherein the cleaning composition is provided as a use solution resulting from a dilution of the cleaning composition with water of dilution at a weight ratio of cleaning composition to water of dilution of between about 1:1 and about 1:1000.

9. A cleaning composition according to claim 8, wherein the water of dilution comprises water having a hardness of at least about 1 grain.

10. A cleaning composition comprising:

(a) an anionic surfactant and an alkanolamine; and (b) a water hardness anti-precipitant mixture comprising maleic anhydride/olefin co-polymer and at least EO-PO co-polymer at a weight ratio of the maleic anhydride/olefin co-polymer to the total amount of the EO-PO co-polymer sufficient to prevent visible precipitation of the anionic surfactant and amine on a glass surface when the cleaning composition is diluted with water of dilution at a weight ratio of the cleaning composition to water of dilution of between about 1:1 and about 1:1000 and wherein the water of dilution contains at least 5 grains hardness;

(c) the EO-PO co-polymer having the formula:

$$(EO)_x(PO)_y(EO)_x$$

$$(PO)_y(EO)_x(PO)_y$$

$$(PO)_y(EO)_x(PO)_y(EO)_x(PO)_y$$

wherein EO is an ethylene oxide group, PO is a propylene oxide group, x is between about 10 to about 130 and y is between about 15 to about 70.

11. A concentrate cleaning composition comprising:

(a) between about 0.1 wt % and about 10 wt % anionic surfactant and an alkanolamine; and (b) a water hardness anti-precipitant mixture comprising between about 0.5 wt % and about 1.5 wt % maleic anhydride/olefin co-polymer and between about 0.001 wt % and about 10 wt % EO-PO co-polymer, the EO-PO co-polymer having the formula:

$$(EO)_x(PO)_y(EO)_x$$

$$(PO)_y(EO)_x(PO)_y$$

$$(PO)_y(EO)_x(PO)_y(EO)_x(PO)_y$$

wherein EO is an ethylene oxide group, PO is a propylene oxide group, x is between about 10 to about 130 and y is between about 15 to about 70.

12. The cleaning composition of claim 1, wherein the EO-PO co-polymer has a molecular weight of greater than about 1,500.

* * * * *

UNITED STATES PATENT AND TRADEMARK OFFICE

CERTIFICATE OF CORRECTION

PATENT NO. : 7,592,301 B2
APPLICATION NO. : 10/723455
DATED : September 22, 2009
INVENTOR(S) : Kim R. Smith et al.

It is certified that error appears in the above-identified patent and that said Letters Patent is hereby corrected as shown below:

Column 13, line 37
Delete "roamer" and replace it with --foamer--

Column 14, line 35
Delete "Then" and replace it with --Ten--

Signed and Sealed this

Sixth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,592,301 B2
APPLICATION NO. : 10/723455
DATED : September 22, 2009
INVENTOR(S) : Smith et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 843 days.

Signed and Sealed this

Twenty-first Day of September, 2010

David J. Kappos

David J. Kappos
*Director of the United States Patent and Trademark Office*